US005641015A

United States Patent [19]

Challand

[11] Patent Number: 5,641,015

[45] Date of Patent: Jun. 24, 1997

[54] WATER DISPERSIBLE MOLDS

[75] Inventor: Nigel Challand, Clwyd, Great Britain

[73] Assignee: Borden (UK) Limited, Southampton, United Kingdom

[21] Appl. No.: 454,179

[22] PCT Filed: Dec. 20, 1993

[86] PCT No.: PCT/GB93/02598

§ 371 Date: Aug. 16, 1995

§ 102(e) Date: Aug. 16, 1995

[87] PCT Pub. No.: WO94/14555

PCT Pub. Date: Jul. 7, 1994

[30] Foreign Application Priority Data

Dec. 23, 1992 [GB] United Kingdom ..... 9226815

[51] Int. Cl.[6] ..... B22C 1/18; B22C 9/10; B28B 7/34

[52] U.S. Cl. ..... 164/528; 164/529; 164/369; 106/38.2; 106/38.3; 106/38.9; 106/38.27

[58] Field of Search ..... 164/528, 529, 164/369; 106/38.2, 38.3, 38.9, 38.27

[56] References Cited

U.S. PATENT DOCUMENTS 4,233,076 11/1980 Blanc et al. ..... 106/38.3

5,143,665 9/1992 Clubbs et al. ..... 106/38.3

FOREIGN PATENT DOCUMENTS 63-132745 6/1988 Japan ..... 164/529

1342580 10/1987 U.S.S.R. ..... 164/528

1239945 5/1992 U.S.S.R. ..... 164/528

9206808 4/1992 WIPO .

9319870 10/1993 WIPO .

*Primary Examiner*—Joseph J. Hail, III

*Assistant Examiner*—I.-H. Lin

*Attorney, Agent, or Firm*—Watson Cole Stevens Davis, PLLC

[57] ABSTRACT

A water-dispersible mold for making a casting comprises a water-insoluble particulate material, such as foundry sand, a binder which includes polyphosphate chains and/or borate ions, and at least one fine particulate refractory material such as one selected from finely particulate silica, silicates and aluminosilicates. The incorporation of the fine particulate refractory results in improvements in the strength and related properties of the mold, when hot, prior to casting.

35 Claims, 5 Drawing Sheets

FIG. 5 Graph of Hot Tensile Strength of test piece cores against percentage Calcium Silicate addition
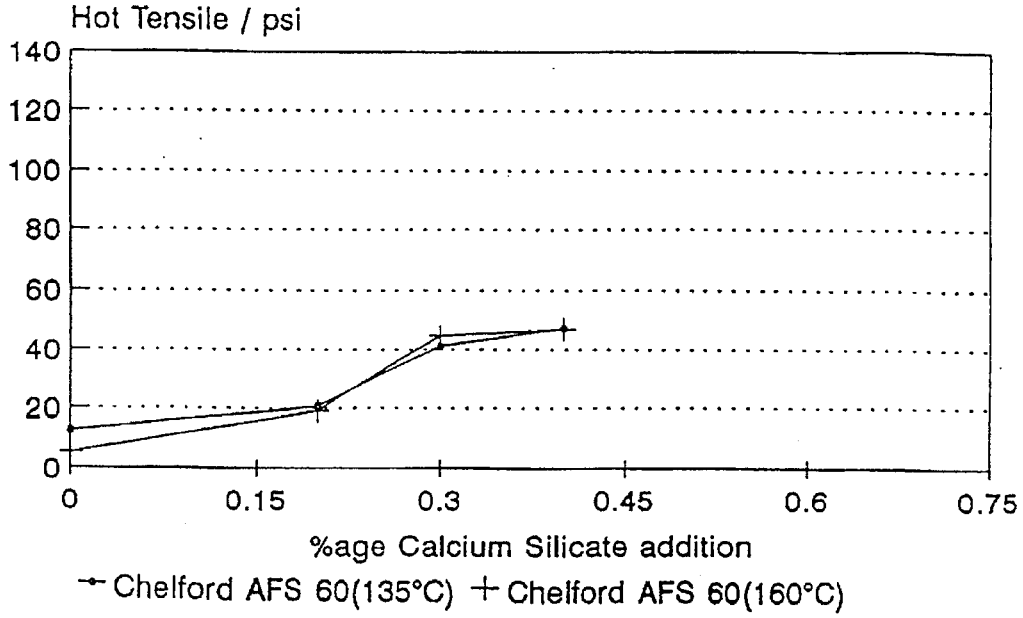
FIG. 6 Graph of Hot Tensile Strength of test piece cores against percentage Feldspar addition
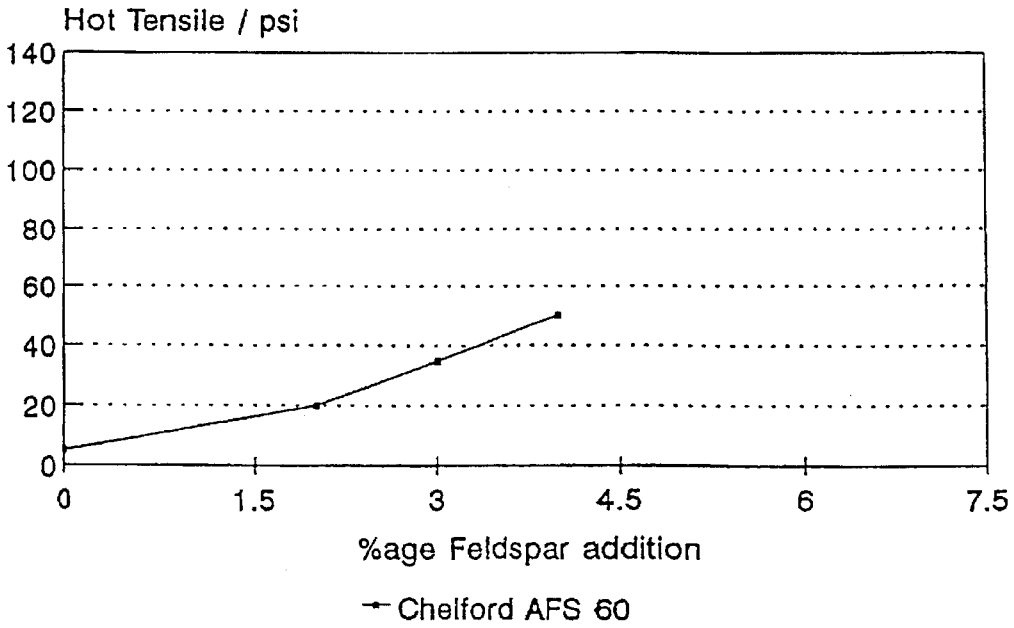

Graph of Hot Tensile Strength of test piece cores against percentage Sodium Aluminosilicate addition FIG. 8 Graph of ultimate Tensile Strength and slurry viscosity, against percentage addition Sodium Aluminosilicate
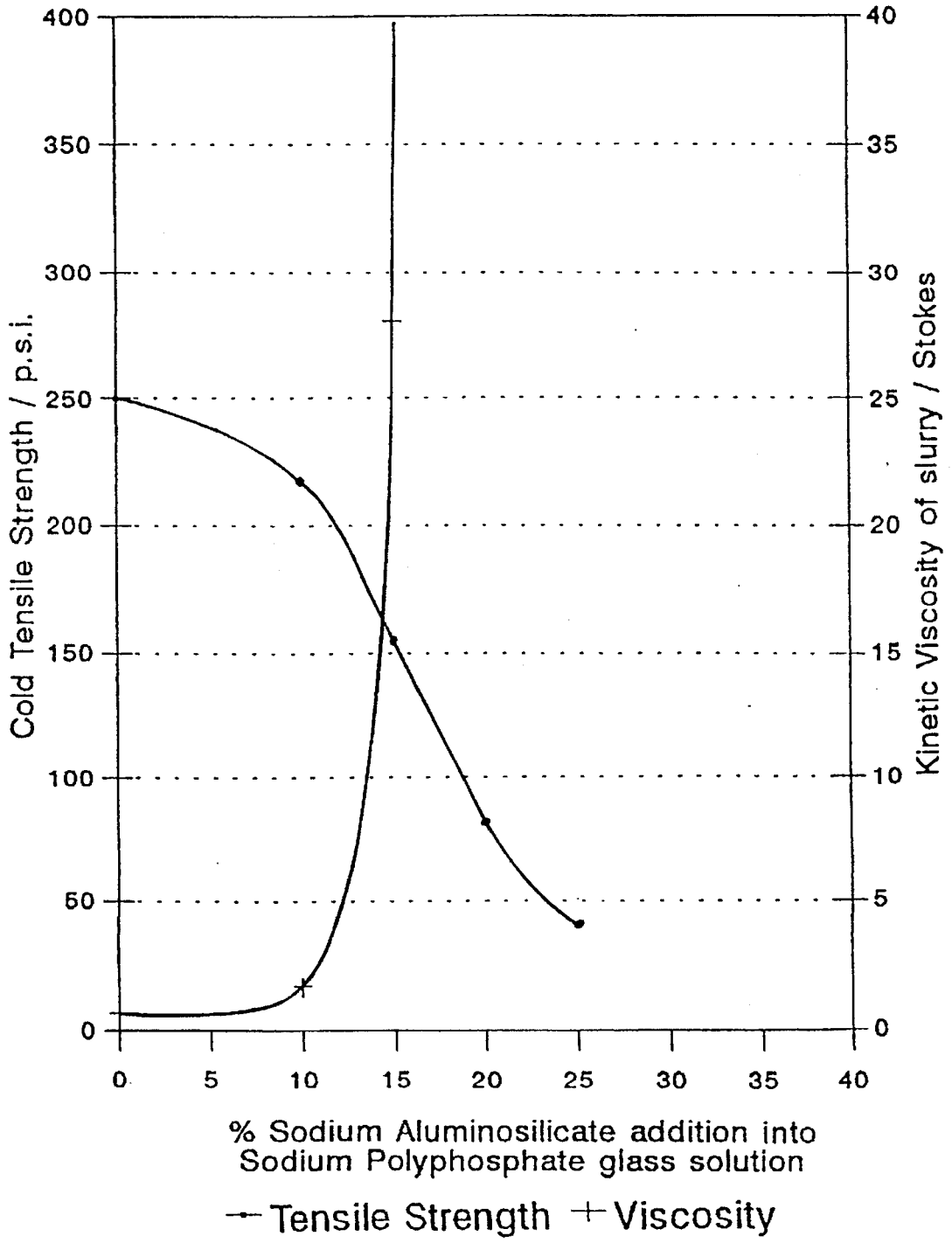

WATER DISPERSIBLE MOLDS

CROSS-REFERENCE TO RELATED APPLICATION

This application is a 371 of PCT/GB93/02598, filled Dec. 20, 1993.

This invention relates to water dispersible moulds for use in making foundry castings or injection mouldings.

The term "mould" as used in this specification includes both a mould for producing castings with or without cavities, and a core for producing a cavity in a cavity-containing casting, and combinations of such moulds and cores. The term "casting" used in the specification encompasses foundry casting and other moulding processes such as injection moulding.

Cores and moulds are made from sand or other refractory particulate materials and it is customary to add binders in order to give the necessary properties of flowability (to enable the core/mould to be formed), stripping strength (to enable cores/mould to be handled soon after forming) and the ultimate strength to withstand the conditions occurring during casting.

The refractory particulate materials and binder are formed into a core or mould by various processes which include ramming, pressing, blowing and extruding the mix into a suitable forming means such as a core box, a moulding flask, or a moulding or mould box. A mould is generally left in the forming means or alternatively it may be removed therefrom; a core is removed from the forming means, optionally after a curing step in which the core is cured to a higher strength than the green strength. If the curing step is omitted the core requires sufficient green strength so that on removal from the forming means the mixture does not collapse. The core or mould is then allowed to cure, artificially cured or baked to further increase its strength so that it will resist the pressure and erosion effects of the molten metal and retain its shape without breakage or distortion until the metal has solidified. Some binders for the refractory particulate materials result in cores which are difficult to remove from the cavity after casting. Some cores, particularly those employing a sodium silicate binder, increase in strength when exposed to high casting temperatures. The result is that the core is not water dispersible and is difficult to break up mechanically in order to remove it from the casting.

It is well known to employ, for the production of castings, cores or inserts made from a ceramic composition around which the metal or alloy is cast. The cores or inserts are removed after casting by mechanical means, for example by percussion drilling, or in the case of complex shapes or fragile castings by dissolution in a solvent which does not react with the metal of the casting. Alternatively, if an organic binder is used the casting and core may be heated to a temperature approaching the melting point of the casting to break down the organic binder.

A suitable core must satisfy a range of requirements. For instance, it must be capable of being shaped and of maintaining that shape throughout the casting process; it must withstand elevated temperatures; it must be removable from the casting without damaging the casting; and it must be made of a material or materials that do not damage or weaken the casting. The core must also be stable and provide a high quality surface finish.

U.S. Pat. No. 3,764,575, U.S. Pat. No. 3,963,818 and U.S. Pat. No. 4,629,708 each disclose methods for using dispersible cores in a casting process. For instance U.S. Pat. No. 4,629,708 uses a mixture of a water soluble salt, a calcium silicate and a binder. Examples of suitable materials of the water-soluble salt include potassium chloride, sodium metasilicate or preferably sodium chloride. The binder may be a paraffin wax, a synthetic organic resin, a silicone resin or preferably polyethylene glycol. The mixture is injection moulded and then fired to drive off organics and to sinter particles of the water soluble salt. After casting the core is removed by dissolution in water. The nature of the core material means that time needed for removal of the core can be commercially unacceptable. The solution being in contact for a relatively long period with the casting can cause corrosion.

U.S. Pat. No. 3,764,575 discloses a core comprising a water soluble salt, such as alkali or alkali earth metal chlorides, sulphates or borates, water-glass and synthetic resin as binder.

U.S. Pat. No. 3,963,818 claims to avoid the corrosion problem mentioned above. This specification discloses compressing a dried inorganic salt, such as sodium chloride, at a pressure between 1.5–4 tons per square centimeter. However it has been found that under practical foundry conditions corrosion does occur when a compressed inorganic salt is dissolved. Further the compression moulding technique for forming the core limits the range of cores that can be used as it does now allow complex cores to be formed. Also such cores tend not to be sufficiently strong for high pressure die casting.

The use of cast cores of sodium silicate has also been suggested. However this involves the formation of a melt at a relatively high temperature, and the cast core has a relatively low solubility so that removal with water takes a long time. Contact with hot metal can also cause incipient cracks in the core, which result in the casting having an irregular surface. The use of phosphate salts i.e., crystalline phosphate materials such as sodium phosphate has been suggested in U.S. Pat. No. 1,751,482, but this material does not give a stable mould.

Green sands moulds used for producing cavity free castings have gained a widespread acceptance because of their low cost and superior mouldability. In such moulds, the green strength is achieved primarily by shaping the mixture of sand and a binder such as bentonite by a mechanical force. Such moulds may be difficult to use when producing large castings e.g., from cast iron as the silica sand reacts with oxidised iron to form iron silicate which tends to adhere to the resulting casting. This means that the casting must be finished after casting by a process such as shot blasting which produces vibration, noise and dust. Self-curing moulds can be produced using various binders but conventional self-curing moulds are water insoluble, and the casting must often be released from the mould by applying a heavy impact to the mould. This involves heavy vibration, noise and dust which all worsen the working environment.

WO92/06808 discloses a water dispersible mould for making a casting which overcomes the problems of the prior art discussed above. The water dispersible mould according to this document comprises a water-insoluble particulate material and a binder therefor, the binder including polyphosphate chains and/or borate ions.

It has now been discovered that the incorporation of fine particulate silica, silicate, aluminosilicate or other fine particulate refractory material into the composition disclosed in WO92/06808 results in an improvement in the strength and related properties of the mould, when hot, prior to casting.

The present invention provides a water-dispersible mould for making a casting, the mould comprising a water-insoluble particulate material and a binder therefor, the binder including polyphosphate chains and/or borate ions characterised in that the mould further contains at least one fine particulate refractory material. The fine particulate refractory material is preferably selected from silica, silicates and aluminosilicates.

The present invention also provides a process for making a water-dispersible mould for making a casting which process comprises the steps of:

a) providing a water-insoluble particulate material;

b) combining the water-insoluble particulate material with a binder including polyphosphate chains and/or borate ions, the chains and/or ions being dissolved in water, and with at least one fine particulate refractory material;

c) forming, either during or after step (b), the mixture of the water-insoluble particulate material, binder and fine particulate material into a desired shape; and d) removing free water from the mixture.

In one preferred embodiment, the binder is mixed with the water-insoluble particulate material and the fine particulate material in the form of an aqueous solution of at least one water-soluble glass. In another preferred embodiment, the binder is mixed with the water-insoluble particulate material and the fine particulate material in the form of particles of at least one water-soluble glass, and the polyphosphate chains and/or borate ions are formed by mixing water with the mixture of particulate material and glass particles. The glass particles may be wholly or partially dissolved into the water thereby to form the polyphosphate chains and/or borate ions.

According to a further embodiment, the removal of free water from the mixture in step d) above is partly achieved by oven drying the mould at a temperature in excess of 100° C.

According to a preferred aspect of the present invention there is provided a method for making a mould used in the manufacture of foundry castings, the method comprising the steps of:

a) providing a water-insoluble particulate material;

b) combining the water-insoluble particulate material with a binder including polyphosphate chains and/or borate ions (the chains and/or ions being dissolved in water) and at least one fine particulate refractory material (preferably selected from silica, silicates and aluminosilicates);

c) heating the mixture of water-insoluble particulate material and binder to a temperature in excess of 100° C.;

d) forming the particulate material and binder mixture into a desired shape; and e) removing water from the mixture with air at a temperature in excess of 100° C.

The elevated temperature of the mixture in (c) and the air in (e) results in a significantly lower cure time than if both mixture and air were at ambient, as rate of water removal is greatly increased.

By "fine particulate material" we mean one which has a particle size not greater than 100 μm, and preferably less than 10 μm, with a surface area preferably greater than 50 $m^2g^{-1}$ which may be provided by a degree of porosity. The fine particulate material should be water insoluble and also heat stable to 700° C. According to one embodiment, the fine particulate material is produced synthetically by precipitation. The precipitation process results in primary particles in the range of from 10–60 nm which aggregate together to form a secondary particle of several μm in size. Material thus produced has greater porosity and surface area than the natural material, and consequently the necessary addition level is lower than that of the natural material. The synthetic material may be three times the cost of the natural material, however the necessary addition level of the natural material may be ten times that of the synthetic material. It is thus cost effective to use the synthetic material. In another preferred embodiment of the invention the binder in (b) contains a molecular sieve material $Na_{86}[(Al\ O_2)_{86}(SiO_2)_{106}].XH_2O$ in powdered form. The particle diameter is less than 10 μm and the nominal pore size is about 1 nm.

The amount of fine particulate refractory material useful in the present invention to improve the hot strength properties of a mould or core depends on the ultimate strength required by the mould or core in a particular application. Typically, the fine particulate refractory material will be added in an amount which is not less than 0.02% by weight based on the total weight of the mould or core since lower amounts tend not to bring about any measurable improvement in hot strength properties. Since the fine particulate refractory material is preferably added as a slurry in an aqueous solution of the binder, e.g., glass solution, the maximum addition possible may be determined by maximum viscosity of the slurry that can be tolerated. For instance, for a sodium aluminosilicate slurry in sodium polyphosphate glass solution the viscosity increases substantially at additions of sodium aluminosilicate of between 10 and 15% by weight based on the weight of the glass solution. The maximum addition is, of course, also determined by the ultimate strength desired. Taking these effects into account, we believe that the maximum addition of fine particulate refractory material will typically be not greater than 1.0% by weight based on the total weight of the mould or core. Preferably, the addition will be in the range of from 0.2 to 0.8% and more preferably from 0.3 to 0.6% by weight based on the total weight of the mould or core.

Examples of fine particulate materials that can be used in the present invention include silica, calcium silicate, sodium aluminosilicate and powdered feldspar.

Without wishing to be bound by theory, it is believed that fine particulate silicas, silicates and aluminosilicates or other refractory materials are able to absorb the chemically bound water which is released from polyphosphate and borate binders during the dehydration cure step. With binders that contain polyphosphate chains in aqueous solution, phosphate hydrates are formed before and during the dehydration cure step. Once all of the free water is removed, some of the chemically bound water contained in the phosphate hydrate is released. This release of chemically bound water can partially redissolve the phosphate binder resulting in softening and distortion of the mould. Fine particulate silicas, silicate and aluminosilica or other refractory materials well dispersed into the binder, especially those with a high surface area, are able to absorb the released chemically bound water before it redissolves the phosphate binder.

The water-soluble glass may be wholly vitreous or partially devitrified, in the latter case the water-soluble glass having been heated and cooled thereby to form crystalline regions in an amorphous or glassy phase.

Preferably, the water-soluble phosphate glass comprises from 30 to 80 mol % $P_2O_5$, from 20 to 70 mol % $R_2O$, from 0 to 30 mol % MO and from 0 to 15 mol % $L_2O_3$, where R is Na, K or Li, M is Ca, Mg or Zn and L is Al, Fe or B.

Without wishing to be bound by theory, it is believed that the polyphosphate chains are formed following the dissolution of the respective water-soluble glasses into aqueous solution. These chains form an interlinking matrix throughout the mould, which is enhanced by hydrogen bonding of the chains by chemically bonded water molecules. After removal of excess water, the resulting dried mould retains the polyphosphate matrix which firmly binds together the water-insoluble particulate material. If excess water were not removed, the resulting wet mixture could be structurally weakened by the presence of water and would generally not be usable as a mould or core. In addition, the excess water would generate steam during the casting process which, as is well known in the art, would degrade the quality of the resultant casting.

Generally, the principal component in a mould is a water-insoluble particulate material which may be a refractory such as a foundry sand e.g., silica, olivine, chromite or zircon sand or another water-insoluble particulate refractory material such as alumina, an aluminosilicate or fused silica. The silica sands used for foundry work usually contain 98% weight $SiO_2$. The mould may also contain minor amounts of other additives designed to improve the performance of the mould.

Preferably, the binder comprises at least 0.25% by weight, and the particulate material comprises up to 99.75% by weight, of the total weight of the particulate material and the binder. More preferably the binder comprises from 0.5 to 50% by weight, and the particulate material comprises from 99.5 to 50% by weight, of the total weight of the particulate material and the binder.

The invention is of particular value in forming cores for use in casting processes involving the formation of cavities. Such cores are normally formed in core boxes.

In one embodiment, in step (b) the binder which is mixed with the water-insoluble particulate material and the fine particulate material is in the form of an aqueous solution of at least one water-soluble glass.

In another embodiment, in step (b) the binder which is mixed with the water-insoluble particulate material and the fine particulate material is in the form of particles of at least one water-soluble glass and the polyphosphate chains and/or borate ions are formed by mixing water with the mixture of refractory particulate material and glass particles.

In the second embodiment, the water may be added in an amount of up to 13% by weight based on the total weight of the mixture. The water may be added either before, during or after the mixture is blown into a mould box during the forming step.

When the water is added to the mixture during or after the delivery of the mixture into the mould box the water is typically added in the form of steam or as a fine water spray. The steam or spray is preferably forced through the mixture under pressure to ensure that the mixture is sufficiently wetted. However when using a core box it has been found preferable to wet the mixture before transferring to the core box.

The moistened glass particles or mixture of glass particles with sand form a flowable mixture even in the presence of the added water. We believe that the water causes sufficient dissolution of the glass surface to provide polyphosphate chains and/or borate ions which interact to form a matrix which tends to cause a gelling action or adhesion of one refractory particle to another. This results in a compacted core which is transferable from the core box, and after removal of free water is handleable without damage under normal foundry working conditions.

The quantity of water used should be such as to ensure the mixture is sufficiently wetted so that the refractory particles adhere to one another. As the glass content is increased more water becomes necessary to wet all the glass particles. If the water is to be introduced before the sand is mixed with the glass then care must be taken to add the glass to the water and not vice versa to ensure an adequate consistency. With high glass amounts (i.e., greater than 5%), if enough water is added to dissolve completely all glass (i.e., greater than 5%) before or whilst the mixture is being delivered into the core box the mixture will become too wet and sticky and as a result the mixture will tend to become a coherent mass which will not flow into the core box used to shape the core.

In general at most particle sizes we have found that no problems are experienced when the amount of water is not more than 13% by weight. Selection of a particular water content will also depend on the amount of time the water is left in contact with the mixture (especially if the water is added before the cure mixture is delivered into the core box), temperature and the solubility of the glass used. Generally the higher the water content the stronger the resultant core tends to be. The appropriate amount of water to use in particular circumstances can be determined in relation to the particular parameters by relatively simple tests. The amount of water may be controlled in relation to the type and amount of glass present. Thus the water may be sufficient completely to dissolve all of the glass particles or alternatively may only partially dissolve the glass particles thereby to leave residual glass particles in the mould or core. Typically, for both a coarse foundry sand (i.e., AFS 50) and a fine foundry sand (i.e., AFS 100) we have found that the preferred weight ratio of glass:water is 1:1–1.5 when water is added to a mixture of glass particles and sand.

The core may also be coated to improve the resultant finish on the casting, however care must be taken to ensure that the coating does not contain free or excess water as this could degrade the core.

Preferably, the water-soluble phosphate glass comprises from 30 to 80 mol % $P_2O_5$, from 20 to 70 mol % $R_2O$, from 0 to 30 mol % MO and from 0 to 15 mol % $L_2O_3$, where R is Na, K or Li, M is Ca, Mg or Zn and L is Al, Fe or B. More preferably, the water-soluble phosphate glass comprises from 58 to 72 wt % $P_2O_5$, from 42 to 28 wt % $Na_2O$ and from 0 to 16 wt % CaO.

Such glasses include glasses of the following compositions in weight %:

| | 1 | 2 | 3 | 4 | 5 | 6 |
|---|---|---|---|---|---|---|
| $P_2O_5$ | 70.2 | 67.4 | 64.6 | 61.8 | 59.0 | 60.5 |
| $Na_2O$ | 29.8 | 28.6 | 27.4 | 26.2 | 25.0 | 39.5 |
| CaO | — | 4 | 8 | 12 | 16 | 0 |

As soluble glass, it is preferred to use a glass which has a solution or solubility rate of 0.1–1000 mg/cm$^2$/hr at 25° C. The glass preferably has a saturation solubility at 25° C. of at least 200 g/l, more preferably 800 g/l or greater, for phosphate glasses, and of at least 50 g/l for borate glasses.

The commonly available phosphate glasses are those from the binary system $Na_2O.P_2O_5$. The selection of glasses containing $K_2O$ or mixed alkali metal oxides can be made on the same basis but glasses containing $K_2O$ and/or mixtures of alkali metal oxides are less likely to be satisfactory as they are more prone to devitrification, and are also likely to be more costly.

A preferred glass is a phosphate glass from the binary system $Na_2O:P_2O_5$, with a molar ratio in the vicinity of $5Na_2O$ to $3P_2O_5$. Although such glasses can vary slightly in composition, we have satisfactorily used a glass containing $P_2O_5$ 60.5 weight %, $Na_2O$ 39.5 weight %. Such a glass has phosphate chains with an average value of n=4.11, n being the number of phosphate groups in the chain. Glasses with longer chain lengths such as n=30 when used as a binder give moulds with a satisfactory strength to withstand the conditions encountered in both handling the mould and using it for casting but can produce a mould which after use in certain casting processes such as die casting of aluminium requires relatively longer treatment with water to achieve disintegration and removal. Typically a mould made with a glass with a chain length of about 30 requires about 10 minutes soaking in water and 30 seconds flushing with water for removal, compared to less than 1 minute soaking in water and 30 seconds flushing for a glass with a chain length of about 4. Thus where quick removal is required the shorter chain length glass is preferred.

We have carried out a variety of studies in order to assess the suitability of various water-soluble sodium polyphosphate glasses for use as binders. The following table shows compositions of some of the glasses tested:

| Glass Sample Number | Wt % $P_2O_5$ | Wt % $Na_2O$ | Water |
|---|---|---|---|
| 1 | 69.0 | 30.5 | Balance |
| 2 | 67.0 | 32.5 | Balance |
| 3 | 65.0 | 34.5 | Balance |
| 4 | 63.0 | 36.5 | Balance |
| 5 | 60.5 | 39.0 | Balance |
| 6 | 58.0 | 41.5 | Balance |

We have noticed that as the $Na_2O$ content of the sodium polyphosphate glasses increases, the phosphate chain length generally becomes shorter and this in turn tends to increase the tensile strength of the core formed with the phosphate binder. We believe, without being bound by theory, that shorter phosphate chains may be better able to utilise hydrogen bonding and that the more chain end phosphate groups present may give stronger hydrogen bonding. We have also found with sodium polyphosphate glasses that as $Na_2O$ content increases the dispersibility of a core employing such glasses as a binder tends to increase. We believe that this may indicate that the ability of partially hydrated glass to fully rehydrate and dissolve into solution is affected by small changes in composition.

In addition, we have found that as the $Na_2O$ content increases, the viscosity of the solution of the sodium polyphosphate glass in water also tends to increase. We believe that this tendency for an increase of viscosity may possibly indicate the tendency to have hydrogen bonding in aqueous solution. This in turn may possibly indicate that viscosity may indicate the suitability of a given sodium polyphosphate glass to be effective as a binder to give good solubility and tensile strength. As specified hereinbefore, the glass must have a sufficiently high saturation solubility and solubility rate to enable it quickly and sufficiently to go into aqueous solution. We have found that all the glasses specified in the above Table have sufficient solubility rates and saturation solubility values. We have also found that an important practical aspect of the choice of polyphosphate glasses for forming cores is related to the shelf life which the core will be required to be subjected to in use. We have found that as the $Na_2O$ content of the sodium polyphosphate glass increases, the tendency for the resultant core to be at least partially rehydrated by atmospheric moisture can increase, this leading to a consequential reduction in the tensile strength of the core thereby reducing the effective shelf life of the core. If the tensile strength is reduced in this manner the core may break prior to the casting process or may degrade during casting. Furthermore, we have found that the suitability of the various sodium polyphosphate glasses in any given casting process can depend on the temperature to which the resultant core is subjected during the casting process. We believe that this is because the temperature of the casting process can affect the binder in the core having consequential implications for the dispersibility of the core. For the use of a sand core during aluminium gravity die casting, the centre of a core may be subjected to temperatures of around 400° C. but the skin of the core may reach temperatures as high as 500° C. The dispersibility of cores generally decreases with increasing temperature to which the cores have been subjected. In addition, the variation of dispersibility with composition may vary at different temperatures. We believe that indispersibility of the core after the casting process may be related to the removal of all combined water in the core which was previously bound with the sodium polyphosphate binder. In order to assess water loss of various sodium polyphosphate binders we carried out a thermogravimetric analysis on hydrated glasses. A thermogravimetric analysis provides a relationship between weight loss and temperature. Thermogravimetric analyses were carried out on a number of sodium polyphosphate glasses and it was found that in some cases after a particular temperature had been reached there was substantially no further weight loss which appeared to suggest that at that temperature all combined water had been lost from the glass. We have found that if this temperature is lower than the temperature to which the core is to be subjected to during a casting process, this indicates that the core may have poor post-casting dispersibility resulting from excessive water removal from the core during the casting process. A suitable core binder also requires a number of other features in order to be able to produce a satisfactory core, such as dimensional stability, absence of distortion during the casting process, low gas evolution and low surface erosion in a molten metal flow.

Overall, it will be seen that there are a variety of factors which effect the choice and suitability of a binder. For any given application, the choice of a binder can be empirically determined by a trial and error technique. However, the foregoing comments give a general indication as to the factors affecting the properties of the binder. What is surprising is that from the combination of these factors, an inorganic binding material, such as a polyphosphate, can be subjected to the temperatures involved in a casting process and still remain readily soluble so as to enable a sand core which is held together by a binder of the polyphosphate material rapidly to be dispersed in water after the high temperature casting process.

Preferably, in the forming step the mixture is blown into a core box by a core blower.

Preferably in step (b) the binder comprises at least 0.25% by weight, and the particulate material comprises up to 99.75% by weight, of the total weight of the particulate material and the binder. More preferably in step (b) the binder comprises from 0.5 to 50% by weight, and the material comprises from 99.5 to 50% by weight, of the total weight of the particulate material and the binder.

When the particle size of the particulate material is relatively small, a relatively large amount of binder will be required in order to ensure that the binder matrix binds together the larger number of particles which provide a correspondingly large surface area.

It has been found where the amount of binder is relatively small as compared to the quantity of sand or other particulate material, it is preferable to introduce the water and glass in the form of a solution of the glass in water. Typically, for a coarse foundry sand (i.e., AFS 50) we have found that the preferred weight ratio of glass:water is 1:0.75–1 when producing a glass solution, and the equivalent glass:water ratio for a fine foundry sand (i.e., AFS 100) is 1:1–1.5. The glass in a powdered form is simply added to water and mixed with a high shear mixer to achieve full solution. A portion of the solution is then added to the refractory particulate material and mixed thoroughly before e.g., blowing the mixture into a core box preheated to 80° C. with compressed air at a pressure of about 80 pounds per square inch, and then purging with compressed air at ambient temperature for about 50 seconds. Cores with good handling strengths are obtained in this manner. Moulds can also be formed.

The removal of water from the mould can be carried out in a number of ways. In the case of a core, the initial treatment of the core while in the core box can reduce the time needed to complete removal of water when the core is removed from the box. A preferred route is to heat the core box to a temperature in the range 50°–90° C. and purge with compressed air, typically at a pressure of 80 pounds per square inch for 30 seconds to 1 minute depending on core size and glass composition. The core is then transferable without damage to an oven where final removal of free water can be accomplished by heating at a temperature in excess of 100° C., preferably in the range 120° C. to 150° C. Using an unheated core box and a compressed air purge having a pressure typically in the range 60–80 pounds per square inch, it is necessary to leave the core, for instance for about 4 minutes, while purging to obtain a handleable core. Compressed air at a temperature in the range 50° to 90° C. and a pressure of about 80 pounds per square inch can also be used, and in this case the core is transferable after about 1 minute. We have found that by using glass solutions, when the preheat temperature of the core box is greater than 100° C. the compressed air purge time can be reduced to about 10–15 seconds and no final drying step is required. If a core box is made of a material which is substantially transparent to microwaves e.g., an epoxy resin, the box containing a core may be transferred to a microwave oven and the core dried in about two minutes using a power of about 700 watts and the final drying step in an oven at 120° C. to 150° C. is not needed. Vacuum drying at a temperature of about 25° C. (room temperature) and a vacuum of 700 mm Hg can also be used. A further alternative is to blow cold i.e., room temperature dried air through the core for a period of approximately 4 to 20 minutes.

The removal of the mould after casting may be simply carried out soaking the casting in a water bath and then flushing the casting with water. The use of water at high pressure in the case of a core encourages the dispersion of the core, especially when intricate moulds are being used. The presence of a wetting agent in the water used to form the core may assist this dispersion. Alternatively, if the presence of a low concentration of alkali ions is tolerable, a small proportion of sodium carbonate in the mould mixture, preferably sodium carbonate decahydrate so that it does not absorb water, may assist the dispersion of the core especially if a dilute acid, such as citric acid is used to flush the core.

BRIEF DESCRIPTION OF THE DRAWINGS

FIG. 5 is a graphical representation of Hot Tensile Strength of test piece cores vs. percentage Calcium Aluminosilicate addition for Examples 8–10;

FIG. 6 is a graphical representation of Hot Tensile Strength of test piece cores vs. percentage of Feldspar addition of Examples 11–12;

FIG. 8 is a graphical representation of ultimate Tensile Strength and Slurry Viscosity vs. percentage addition of Sodium Aluminosilicate for Example 16.

The following examples illustrate but do not limit the invention.

EXAMPLES

Figure 1:
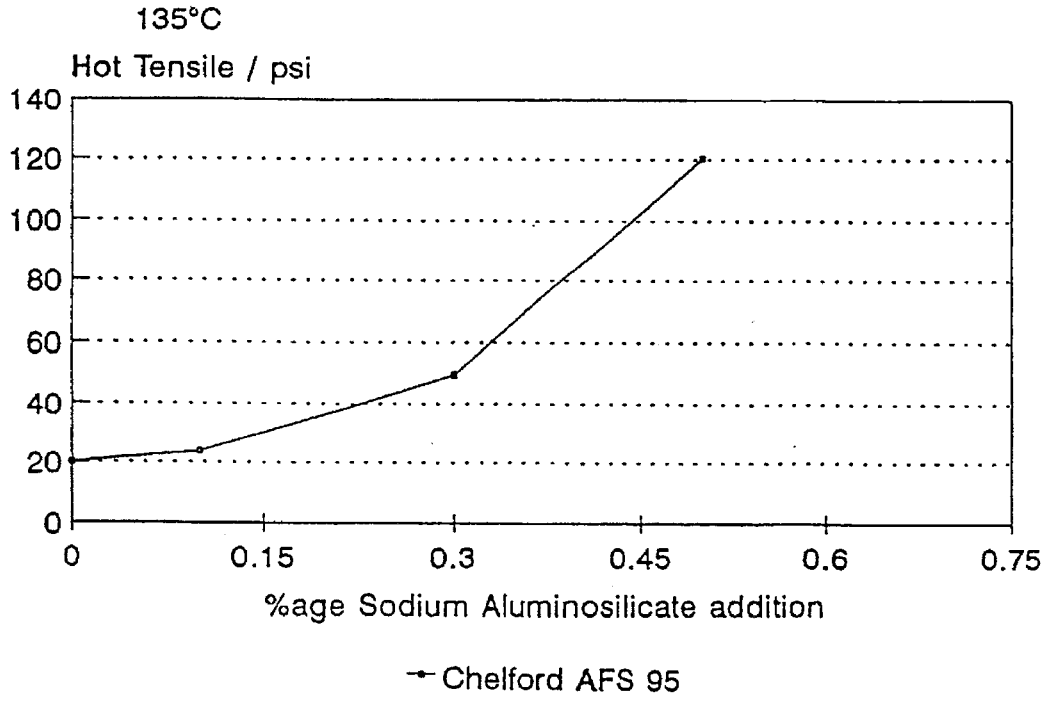
FIG. 1 is a graphical representation of Hot Tensile Strength of test piece cores vs. percentage Sodium Aluminosilicate addition for Examples 1–2.

Example 1 (see FIG. 1)

1 kg of a powdered soluble phosphate glass having a weight percent composition $P_2O_5$ 60.5%, $Na_2O$ 39.5% was added to 1 kg of tap water and mixed with a shear mixer for 5 minutes to achieve full solution. 50 g of <10 micron powdered sodium aluminosilicate of composition $SiO_2$ 81.5%, $Al_2O_3$ 8.5, $Na_2O$ 9.0% was added to 500 g of the polyphosphate glass solution and slurred to achieve full dispersion. 110 g of the slurry was mixed fully with 2 kg of Chelford 95 foundry sand. The resulting sand mix was loaded into a core blower and 10 standard AFS 1"×1" dog bone test pieces made. The text piece die was at 95° C. and all test pieces were partially dehydrated by purging cold compressed air at 90 p.s.i. through the test piece for 90 seconds, whilst in the test piece die. Each test piece was transferred to an oven set at 135° C. for 30 minutes in order to complete dehydration. After 30 minutes in the oven, each test piece was immediately tensile tested. In order to minimise cooling, each dog bone was tensile tested within 10 seconds of removing from the oven. The average of 10 results is shown as one point in FIG. 1, 0.5% sodium aluminosilicate addition.

Example 2 (see FIG. 1)

Example 1 was repeated. However this time only 40 g of the <10 micron powdered sodium aluminosilicate was slurried with 500 g of the sodium polyphosphate glass solution, and only 108 g of the slurry was mixed with 2 kg of Chelford 95 sand. The average of 10 results is again shown as one point in FIG. 1, 0.4% sodium aluminosilicate addition.

Example 1 was further repeated but with only 30 g of the sodium aluminosilicate slurried with 500 g of the sodium polyphosphate glass solution and only 106 g of the slurry was mixed with 2 kg of Chelford 95 sand. The average of 10 results is again shows as one point in FIG. 1, 0.3% sodium aluminosilicate addition.

The final point on FIG. 1 at 0% sodium aluminosilicate addition was achieved by again repeating Example 1, but with only 100 g of sodium polyphosphate glass solution mixed with 2 kg of Chelford 95 sand, and without any of the powdered sodium aluminosilicate.

The resulting trend in FIG. 1 demonstrates the importance of sodium aluminosilicate addition in achieving acceptable hot strength properties.

Figure 2:
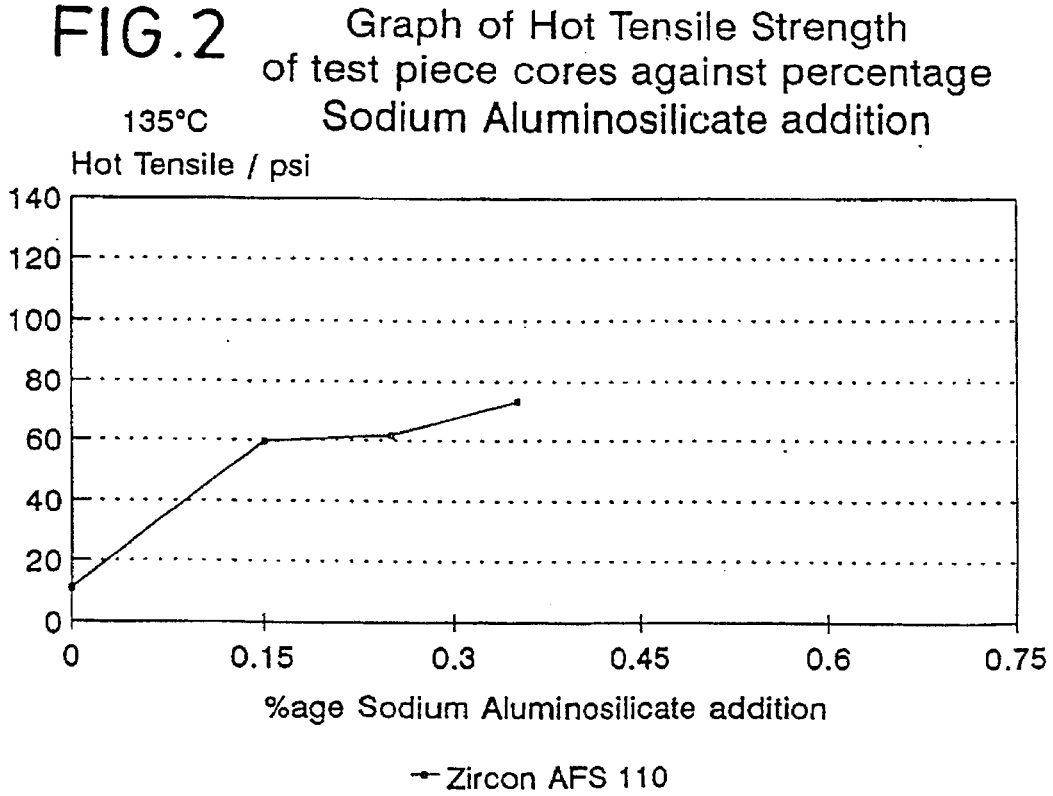
FIG. 2 is a graphical representation of Hot Tensile Strength of test piece cores vs. percentage Sodium Aluminosilicate addition for Examples 3–4.

Example 3 (FIG. 2)

500 g of the sodium polyphosphate glass solution from Example 1 was slurried with 50 g of the <10 micron powdered sodium aluminosilicate from Example 1.

77 g of this slurry was mixed with 2 kg of Zircon AFS 110 foundry sand. Tensile test pieces were made and tested in the same way as those in Example 1. The tensile results are represented by one point in FIG. 2, 0.35% sodium aluminosilicate addition.

Example 4 (FIG. 2)

Example 3 was repeated. However this time, only 35.7 g of the <10 micron powdered sodium aluminosilicate was slurried was 500 g of the sodium polyphosphate glass solution, and only 75 g of the slurry was mixed with 2 kg of Zircon AFS 110 foundry sand. The tensile results are again represented by one point in FIG. 2, 0.25% sodium aluminosilicate addition.

Example 3 was further repeated. However this time, only 21.4 g of the <10 micron powdered sodium aluminosilicate was slurried with 500 g of the sodium polyphosphate glass solution, and only 73 g of the slurry was mixed with 2 kg of Zircon AFS 110 foundry sand. The tensile results are again represented by one point in FIG. 2, 0.15% sodium aluminosilicate addition.

The 0% sodium aluminosilicate addition in FIG. 2 is the same point as that in FIG. 1.

The resulting trend in FIG. 2 demonstrates the importance of sodium aluminosilicate addition in achieving acceptable hot strength properties.

Figure 3:
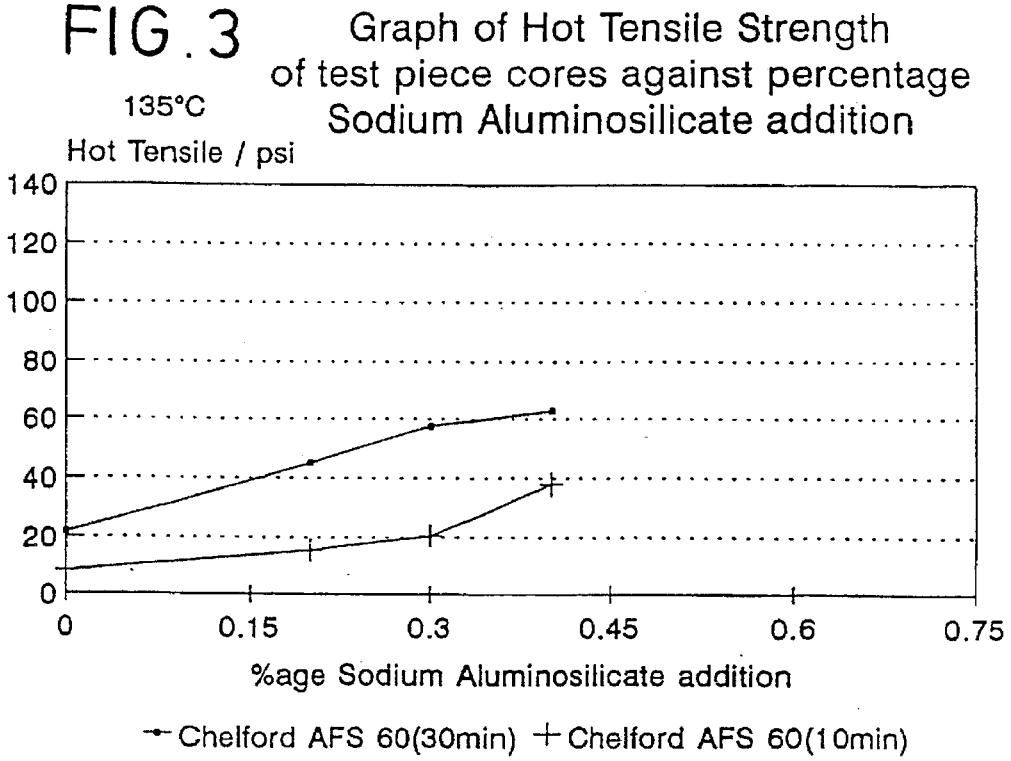
FIG. 3 is a graphical representation of Hot Tensile Strength of test piece cores vs. percentage Sodium Aluminosilicate addition for Examples 5–6.

Example 5 (FIG. 3)

The general method layed-out in Example 1 was further used to generate the data for FIG. 3. The same powdered sodium aluminosilicate was used and the same sodium polyphosphate glass solution was used. However this time, Chelford 60 foundry sand was used. The mixes used to make the test pieces for generating the data were as follows:

| | % sodium aluminosilicate addition | | | |
|---|---|---|---|---|
| | 0 | 0.2 | 0.3 | 0.4 |
| Sand | 2 kg | 2 kg | 2 kg | 2 kg |
| sodium polyphosphate glass soln. | 80 g | 80 g | 80 g | 80 g |
| sodium aluminosilicate powder | 0 g | 4 g | 6 g | 8 g |

Sodium polyphosphate glass solution and sodium aluminosilicate powder are slurried before addition to sand.

Example 6 (FIG. 3)

Example 5 was repeated. However this time, the test pieces were removed from the oven following 10 minutes at 135° C., and immediately tensile tested (refer to the general method in Example 1, where test pieces were removed following 30 minutes in the oven at 135° C.).

The resulting trends in FIG. 3 again demonstrate the importance of sodium aluminosilicate addition in achieving acceptable hot strength properties, and also demonstrates that hot strength increases with time during the oven dehydration step.

Figure 4:
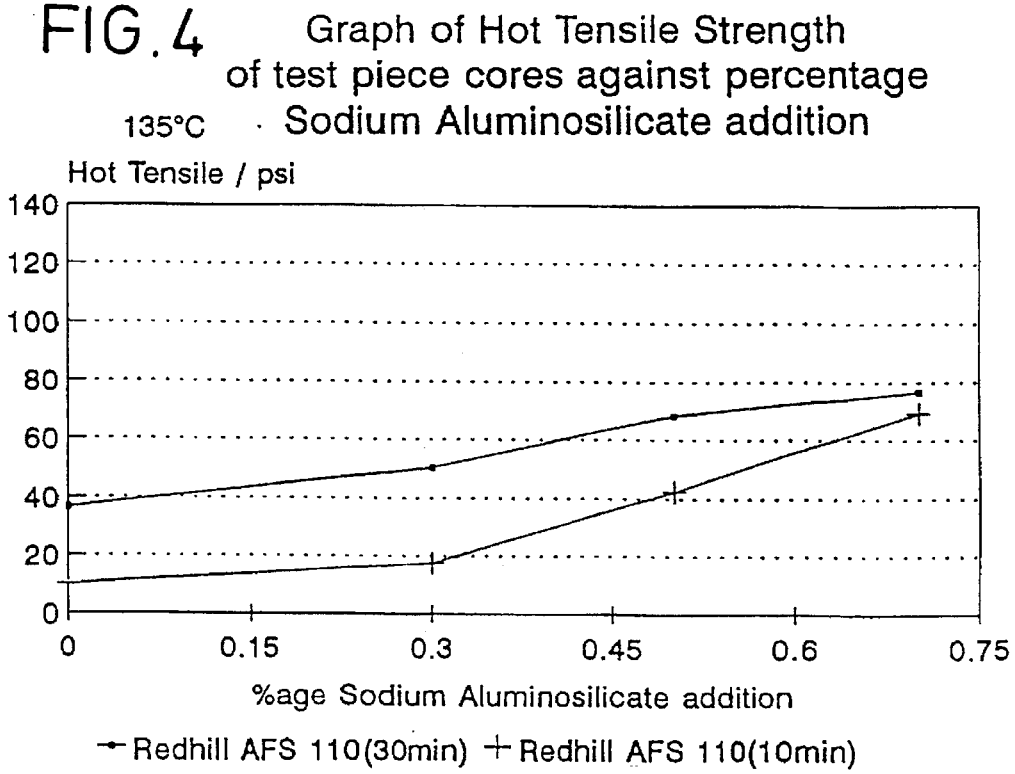
FIG. 4 is a graphical representation of Hot Tensile Strength of test piece cores vs. percentage Sodium Aluminosilicate addition for Example 7.

Example 7 (FIG. 4)

The data for FIG. 4 was generated in the exact same way as that for FIG. 3 (i.e., combine Examples 5 and 6). However this time, Redhill AFS 110 foundry sand was used. The mixes used for generating the data were as follows:

| | % sodium aluminosilicate addition | | | |
|---|---|---|---|---|
| | 0 | 0.3 | 0.5 | 0.7 |
| Sand | 2 kg | 2 kg | 2 kg | 2 kg |
| sodium polyphosphate glass soln. | 140 g | 140 g | 140 g | 140 g |
| sodium aluminosilicate powder | 0 g | 6 g | 10 g | 14 g |

Sodium polyphosphate glass solution and sodium aluminosilicate powder are slurried before addition to sand.

Example 8 (FIG. 5)

500 g of sodium polyphosphate glass solution from Example 1 was slurried with 50 g of <10 micron powdered calcium silicate of composition $SiO_2$: 78%, CaO: 19.3%, $Na_2O$: 2%.

88 g of the slurry was mixed with 2 kg of Chelford 60 foundry sand. The resulting sand mix was used to make test pieces using the general method outlined in Example 1. However, each test piece was removed from the oven and tested following 10 minutes at 135° C. The tensile results are represented by one point in FIG. 5, 0.4% calcium silicate addition, 135° C.

Example 9 (FIG. 5)

Example 8 was repeated. However this time using three slurries with reduced addition of the same powdered calcium silicate. The resulting mixes used for generating the data were as follows:

| | % calcium silicate addition | | |
|---|---|---|---|
| | 0 | 0.2 | 0.3 |
| Sand | 2 kg | 2 kg | 2 kg |
| sodium polyphosphate glass soln. | 80 g | 80 g | 80 g |
| calcium silicate powder | 0 g | 4 g | 6 g |

Data from Examples 8 and 9 combined make the 135° C. curve in FIG. 5.

Example 10 (FIG. 5)

Examples 8 and 9 were repeated. However this time the oven was set at 160° C. The four resulting data points make the 160° C. curve in FIG. 5.

Example 11 (FIG. 6)

500 g of the sodium polyphosphate glass solution from Example 1 was slurried with 500 g of <75 micron powdered feldspar of weight % composition $SiO_2$ 68.0, $Al_2O_3$ 19.0, CaO 1.7, $K_2O$ 2.7, $Na_2O$ 7.7 (a natural material). 160 g of the slurry was mixed fully with 2 kg of Chelford 60 foundry sand. The resulting sand mix was used to make test pieces using the general method outlined in Example 1. However, each test piece was removed from the oven and tested following 10 minutes at 135 ° C. The tensile results are represented by one point in FIG. 6, 4% feldspar addition.

Example 12 (FIG. 6)

Example 11 was repeated. However this time, using three slurries with reduced addition of the same powdered feldspar. The resulting mixes used for generating the data were as follows:

| | % feldspar addition | | |
|---|---|---|---|
| | 0 | 2 | 3 |
| Sand | 2 kg | 2 kg | 2 kg |
| sodium polyphosphate glass soln. | 80 g | 80 g | 80 g |
| feldspar powder | 0 g | 4 g | 6 g |

The resulting trend in FIG. 6 demonstrates the importance of an aluminosilicate addition in achieving acceptable hot strength properties. In addition, it demonstrates that this coarser feldspar, which is a natural material, is less effective than those additives in Examples 1–10.

Figure 7:
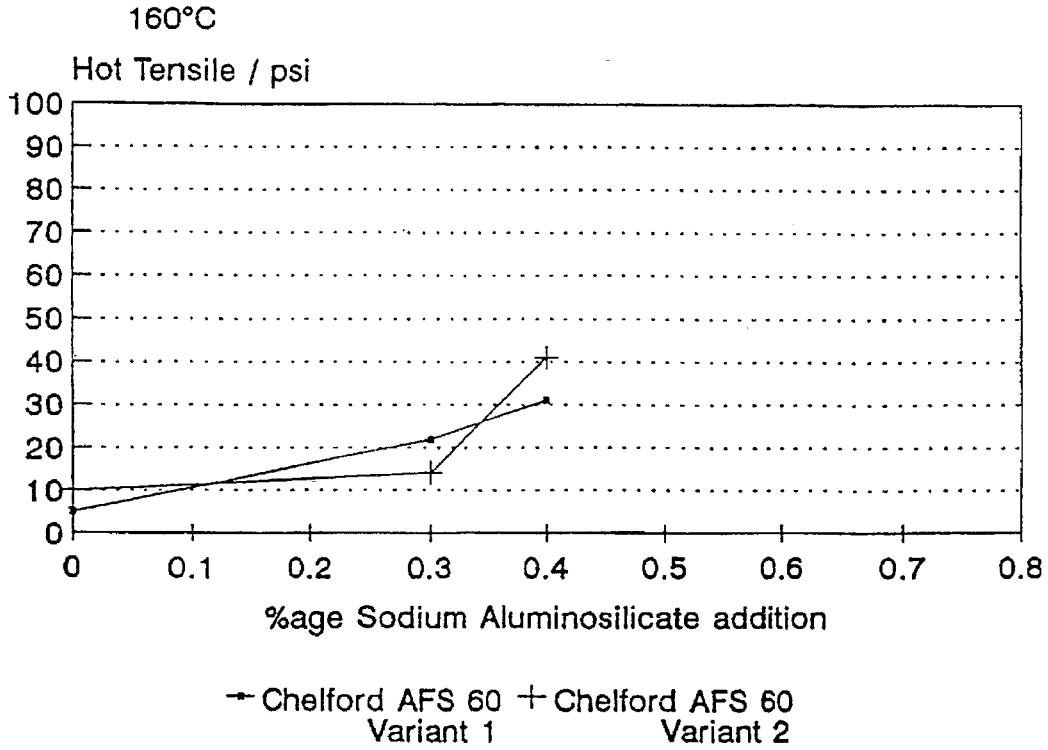
FIG. 7 is a graphical representation of Hot Tensile Strength of test piece cores vs. percentage of Sodium Aluminosilicate addition for Examples 13–14.

Example 13 (FIG. 7)

Example 6 was repeated. However, this time the test pieces were placed in an oven set at 160° C. for 10 minutes immediately prior to testing. Also this time, the 0.2% addition sodium aluminosilicate point was left out. The data forms the 'variant 1' curve in FIG. 7.

Example 14 (FIG. 7)

Example 13 was repeated. However this time, the soluble phosphate glass used had the following weight % composition: $P_2O_5$ 63.5, $Na_2O$ 34.0. The data forms the 'variant 2' curve in FIG. 7.

Example 15

500 g of the sodium polyphosphate glass solution from Example 1 was slurried with 50 g of a <50 microns powdered China clay of the following wt % composition:

| | |
|---|---|
| $SiO_2$ | 46.8 |
| $Al_2O_3$ | 38.0 |
| $Fe_2O_3$ | 0.7 |
| $TiO_2$ | 0.1 |
| CaO | 0.1 |
| MgO | 0.1 |
| $K_2O$ | 1.5 |
| $Na_2O$ | 0.1 |
| L.O.I | 12.6 |

440 g of the slurry was mixed fully with 10 kg of Chelford 80 foundry sand. The mix was loaded into a production core blower, and used to make 400 g thermostat housing cores. The cores were blown at 80 p.s.i. into the core box which was heated electrically to 95° C. The cores were dehydration-purged with compressed air at 100° C. and 80 p.s.i. for 2 minutes, whilst still in the core box. The resulting core was removed from the box and placed in an oven at 135° C. for ½ hour to remove the residual 0.2–0.3% (of core weight) free water. There was no softening of the core during the oven cure/dehydration step. The hot core has a tensile of 70 p.s.i., but as the core cools to ambient its tensile increases to 250 p.s.i.. The cores were used successfully in an aluminium gravity die casting process for making engine thermostat housings.

Example 16

The maximum possible addition of fine particulate refractory material usable in the present invention is limited by virtue of the maximum viscosity of the fine particulate slurry in glass solution that can be tolerated. The fine particulate refractory material increases the viscosity of the solution as illustrated in FIG. 8. In this FIG. 8, which shows the effects of the percentage of sodium aluminosilicate in a sodium polyphosphate glass solution used on the slurry viscosity and the ultimate tensile strength of the mould, it demonstrated that at a critical addition level the viscosity begins to rise dramatically (with a high gradient). In FIG. 8, this occurs at a point slightly greater than 10% addition. At high slurry viscosities, the flow of the slurry itself and the flow of the resulting mix with foundry sand become poor. Therefore, in this Example the preferred maximum addition of sodium aluminosilicate is about 10% by weight based on the weight of the sodium polyphosphate glass solution.

In this Example, the test pieces were made using Chelford AFS 60 foundry sand, the sodium polyphosphate glass solution addition is 4% and the maximum preferred sodium aluminosilicate addition is 0.4% by weight based on the total weight of the mould/core.

With reference to preferred upper addition limits in ultimate mould/core tensile strength terms and referring once more to FIG. 8, we see that if higher viscosity and poorer flow are tolerable, then acceptable ultimate strengths can still be achieved at higher sodium aluminosilicate addition levels. For example at 15% addition on sodium polyphosphate glass solution, the resulting Chelford AFS 60 sand core has an ultimate tensile strength of approximately 150 psi. In this case the sodium polyphosphate glass solution addition is 4% and the sodium aluminosilicate addition is 0.6% (as a % of mould/core weight).

However, at 20% addition, the same core has an ultimate tensile strength of less than 100 psi. In this case the sodium aluminosilicate addition is now 0.8% (as a % of mould/core weight).

This demonstrates that the maximum tolerable addition is dependent on the ultimate strength necessary for the job in hand. For a large mould where only 50 psi ultimate tensile strength is necessary, a sodium aluminosilicate addition of 1.0% (as a % of mould/core weight) could be tolerated.

Technical details for this example:

1 The sodium polyphosphate glass and solution composition are also as in Example 1.

2 The sodium aluminosilicate composition and particle size are also as in Example 1.

3 The practical method outlined in Example 1, was used for making the sample piece. However this time, the pieces were allowed to cool to ambient temperature, once removed from the oven, before tensile testing.

4 The kinetic viscosity was measured on the slurries using a u-tube viscometer.

I claim:

1. A water-dispersible mold or core for making a casting, the mold or core comprising a water-insoluble particulate material and a binder therefor, wherein the binder contains at least one matrix former selected from the group consisting of polyphosphate chains derived from water-soluble phosphate glass and borate ions, characterised in that the mold or core further contains at least one fine particulate refractory material having a particle size of not greater than 100 μm selected from the group consisting of silica, silicates and aluminosilicates in an amount of not greater than 1% by weight based on the total weight of the mold or core.

2. A water-dispersible mold or core according to claim 1, wherein the fine particulate refractory material has a particle size not greater than 10 μm.

3. A water-dispersible mold or core according to claim 2, wherein the fine particulate refractory material is produced synthetically by precipitation.

4. A water-dispersible mold or core according to claim 2, wherein the fine particulate refractory material is selected from powdered sodium aluminosilicate, powdered calcium silicate and powdered feldspar.

5. A water-dispersible mold or core according to claim 1, wherein the fine particulate refractory material is present in an amount not less than 0.02% by weight based on the weight of the mould or core.

6. A water-dispersible mold or core according to claim 1, wherein the borate ions are derived from water soluble borate glass.

7. A water-dispersible mold or core according to claims 6, wherein the water-soluble phosphate glass comprises from 30 to 80 mol % $P_2O_5$, from 20 to 70 mol % $R_2O$, from 0 to 30 mol % MO and from 0 to 15 mol % $L_2O_3$, where R is Na, K or Li, M is Ca, Mg or Zn and L is Al, Fe or B.

8. A water-dispersible mold or core according to claim 7, wherein the water-soluble phosphate glass comprises from 58 to 72 wt % $P_2O_5$, from 42 to 28 wt % $Na_2O$ and from 0 to 16 wt % CaO.

9. A water-dispersible mold or core according to claim 6, wherein the binder has been mixed with the water-insoluble particulate material, wherein said binder is an aqueous solution of at least one of said water-soluble glass and wherein said aqueous solution contains said at least one matrix former.

10. A water-dispersible mold or core according to claim 6, wherein the binder has been mixed with the particulate material in the form of particles of the at least one water-soluble glass and said at least one matrix former being formed by mixing water with the mixture of particulate material and glass particles.

11. A water-dispersible mold or core according to claim 1, wherein the glass has been partially devitrified.

12. A water-dispersible mold or core according to claim 1, wherein the insoluble particulate material is foundry sand.

13. A process for casting a castable material, the process comprising making a water-dispersible mould or core according to claim 1, pouring castable material into contact with the mold or core, allowing the material to solidify in contact with the mold or core so as to adopt the surface shape thereof, and dispersing the mold or core from the solid cast material by treating it with an aqueous liquid.

14. A process according to claim 13, wherein the castable material is liquid metal.

15. A process for making a water-dispersible mold or core for making a casting which process comprises the steps of:

(a) providing a water-insoluble particulate material;

(b) combining the water-insoluble particulate material with a binder wherein said binder contains at least one matrix former selected from the group consisting of polyphosphate chains derived from a water-soluble phosphate glass and borate ions, said at least one matrix former being dissolved in water, and with at least one fine particulate refractory material having a particle size of not greater than 100 μm selected from the group consisting of silica, silicates and aluminasilicates in an amount of not greater than 1% by weight based on the total weight of the mold or core;

(c) forming, either during or after step (b), the mixture of the water-insoluble particulate material, binder and fine particulate refractory material into a desired shape; and (d) removing free water from the mixture.

16. A process according to claim 15, wherein the fine particulate material has a particle size not greater than 10 μm.

17. A process according to claim 16, wherein the fine particulate refractory material is produced synthetically by precipitation.

18. A process according to claim 16, wherein the fine particulate refractory material is selected from powdered sodium aluminosilicate, powdered calcium silicate and powdered feldspar.

19. A process according to claim 15, wherein the fine particulate refractory material is added in an amount not less than 0.02% by weight based on the weight of the mold or core.

20. A process according to claim 15, wherein the borate ions are derived from water-soluble borate glass.

21. A process according to claim 20, wherein in step (b) the binder which is mixed with the particulate material is in the form of an aqueous solution of the at least one water-soluble glass.

22. A process according to claim 21, wherein in step (b) the binder which is mixed with the water-insoluble particulate material is in the form of particles of the water-soluble glass and said at least one matrix former being formed by mixing water with the mixture of water-insoluble particulate material and glass particles.

23. A process according to claim 22, wherein water is added in an amount of up to 13% by weight based on the total weight of the mixture.

24. A process according to claim 15, wherein the water-soluble phosphate glass comprises from 30 to 80 mol % $P_2O_5$, from 20 to 70 mol % $R_2O$, from 0 to 30 mol % MO and from 0 to 15 mol % $L_2O_3$, where R is Na, K or Li, M is Ca, Mg or Zn and L is Al, Fe or B.

25. A process according to claim 24, wherein the water-soluble phosphate glass comprises from 58 to 72 wt % $P_2O_5$, from 42 to 28 wt % $Na_2O$ and from 0 to 16 wt % CaO.

26. A process according to claim 15, wherein in step (d) the mixture, formed into a desired shape, is dried in an oven at a temperature in excess of 100° C.

27. A process according to claim 15, wherein after step (b) the mixture is heated to a temperature in excess of 100° C. after which it is formed into a desired shape and then water is removed from the mixture with air at a temperature in excess of 100° C.

28. A process according to claim 15, wherein the particulate material and binder mixture is blown under pressure into a mould box thereby to shape the mixture into the desired shape.

29. A process according to claim 28, wherein the mould box is heated before the mixture is blown thereinto.

30. A process according to claim 28, wherein the mixture is blown by means of compressed air.

31. A process according to claim 28, wherein after the mixture has been blown into the mould box the mould box filled with the mixture is purged with compressed purging air.

32. A process according to claim 31, wherein the compressed purging air is at an elevated temperature.

33. A process according to claim 30, wherein the elevated temperature is from 50° to 90° C.

34. A process according to claim 31, wherein the water insoluble particulate material is foundry sand.

35. A process for casting a castable material, the process comprising making a water-dispersible mold or core in accordance with the process of claim 15, pouring castable material into contact with the mold or core, allowing the material to solidify in contact with the mold or core so as to adopt the surface shape thereof, and dispersing the mold or core from the solid cast material by treating it with an aqueous liquid.

* * * * *